US008540104B2

(12) United States Patent
Elenes

(10) Patent No.: US 8,540,104 B2
(45) Date of Patent: Sep. 24, 2013

(54) OPTICAL LENS CASE

(76) Inventor: Luis Elenes, Portland, OR (US)

( * ) Notice: Subject to any disclaimer, the term of this patent is extended or adjusted under 35 U.S.C. 154(b) by 0 days.

(21) Appl. No.: 13/473,430

(22) Filed: May 16, 2012

(65) Prior Publication Data

US 2012/0222977 A1 Sep. 6, 2012

Related U.S. Application Data

(63) Continuation-in-part of application No. 12/968,635, filed on Dec. 15, 2010, now Pat. No. 8,281,923.

(51) Int. Cl.
*B65D 53/00* (2006.01)

(52) U.S. Cl.
USPC ..... 220/378; 215/341; 215/348

(58) Field of Classification Search
USPC ..... 206/316.2, 433, 523, 591, 592, 594, 206/811; 220/378; 215/341, 348
See application file for complete search history.

(56) References Cited

U.S. PATENT DOCUMENTS

| | | | | |
|---|---|---|---|---|
| 2,803,368 | A * | 8/1957 | Koch | 220/4.21 |
| 3,018,127 | A * | 1/1962 | Dobrosielski et al. | 292/251 |
| 3,120,319 | A * | 2/1964 | Buddrus | 215/12.2 |
| 3,896,959 | A * | 7/1975 | Roy | 215/222 |
| 5,498,333 | A * | 3/1996 | Canther | 210/198.1 |
| 5,875,916 | A * | 3/1999 | Crockett et al. | 220/324 |
| 8,281,923 | B2 * | 10/2012 | Elenes | 206/316.2 |

OTHER PUBLICATIONS

Pearstone, "Pearstone Onyx 40 Lens Case", accessible at Pearstone website: http://www.pearstone.com/detail?sku=572729. Accessed Aug. 23, 2011.
Aquatech, "Aquatech Lens Wraps", accessible at Aquatech website: http://www.aquatech.net/Lens-Soft-Wrap-ASWLL.php. Accessed Aug. 23, 2011.
Canon, "Canon lens case LX1324", accessible at B&H Photo website: http://www.bhphotovideo.com/c/product/164010-REG/Canon_2794A001_LZ1324_Lens_Case.html, Accessed Aug. 23, 2011.
Canon, "Canon lens case 600", accessible at B&H Photo website: http://www.bhphotovideo.com/c/product/186971-REG/Canon_2804A002_Lens_Case_600.html, Accessed Aug. 23, 2011.
Clik Elite, "Clik Elite CE202GR Lens Holster", accessible at B&H Photo website: http://www.bhphotovideo.com/c/product/629718-REG/Clik_Elite_CE202GR_CE202GR_Lens_Holster_Large.html, Accessed Aug. 23, 2011.

(Continued)

*Primary Examiner* — David Fidei
(74) *Attorney, Agent, or Firm* — Mohr Intellectual Property Law Solutions, PC

(57) ABSTRACT

An apparatus for receiving and protecting interchangeable camera lenses includes a cylindrical body shell having a rigid wall with a soft lined interior surface, a base end cap positioned at a bottom end to form a closed-end floor, and a mouth member disposed at a top end to form an opening sized to receive a camera lens. A lid cap is removably engageable in a two-stage rotational interference fit with the mouth member. In a first stage of the fit, the lid cap is translatable along the axis of the body shell, with respect to the mouth member, between a non fluid tight position and a fluid-tight position; and in a second stage, the lid cap is retained in a fluid-tight position. A kit for creating a customized ring includes a stabilizing disk of an outer dimension to frictionally engage the interior of the body shell, and a guide member.

20 Claims, 6 Drawing Sheets

(56) References Cited

OTHER PUBLICATIONS

F.64, "f.64 LP Lens Pouch" accessible at B&H Photo website: http://www.bhphotovideo.com/c/product/17469-REG/f_64_LP_LP_Lens_Pouch.html, Accessed Aug. 23, 2011.
Lightware, "Lightware Long Lens Tube LT300" accessible at B&H Photo website: http://www.bhphotovideo.com/c/product/357506-REG/Lightware_LT300_Long_Lens_Tube_LT300.html, Accessed Aug. 23, 2011.
Lowepro, "Loweprp Lens Case 13x32cm", accessible at B&H Photo website: http://www.bhphotovideo.com/c/product/752417-REG/Lowepro_LP36307_PAM_Lens_Case_13_x_html, Accessed Aug. 23, 2011.
Mamiya, "Mamiya 210-295 Trunk Case", accessible at B&H Photo website: http://www.bhphotovideo.com/c/product/238172-REG/Mamiya_210_295_210_295_Trunk_Case.html, Accessed Aug. 23, 2011.
Nikon, "Nikon CL-38 Hard Lens Case", accessible at B&H Photo website:http://www.bhphotovideo.com/c/product/37240-REG/Nikon_4471_CL-38_Hard_Lens_Case.html, Accessed Aug. 23, 2011.
Tamrac, "Tamrac MX5378 MAS Lens Case", accessible at B&H Photo website:http://www.bhphotovideo.com/c/product/198712-REG/Tamrac_MX537801_MX5378_M_A_S_Lens_Case.html, Accessed Aug. 23, 2011.
Pelican, "Pelican 1564 Waterproof 1560 Case with Dividers", accessible at B&H Photo website: http://www.bhphotovideo.com/c/product/388345-REG/Pelican_1560_004_110_1564_Waterproof_1560_Case.html, accessed Aug. 23, 2011.
HPRC, "HPRC4050F Waterproof Hard Case", accessible at B&H Photo website: http://www.bhphotovideo.com/c/product/746131-REG/HPRC_HPRC4050FBLACK_HPRC4050F_Waterproof_Hard_Case.html, accessed Aug. 23, 2011.
HPRC, "HPRC4100F Waterproof Hard Case", accessible at B&H Photo website:http://www.bhphotovideo.com/c/product/746150-REG/HPRC_HPRC4100FBLACK_HPRC4100F_Waterproof_Hard_Case.html, accessed Aug. 23, 2011.
SKB, "SKB 3I-1209-4B-L Mil-Std Waterproof Case 4" Deep", accessible at B&H Photo website: http://www.bhphotovideo.com/c/productJ468715-REG/SKB_3I_1209_4B_L_3I_1209_4B_L_Mil_Std_Waterproof_Case.html, accessed Aug. 23, 2011.

* cited by examiner

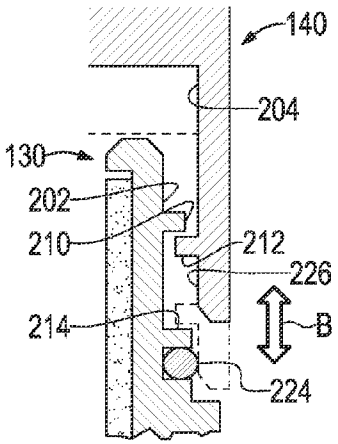
FIG. 11
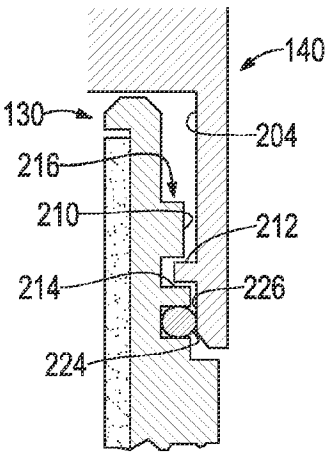
FIG. 12
FIG. 10
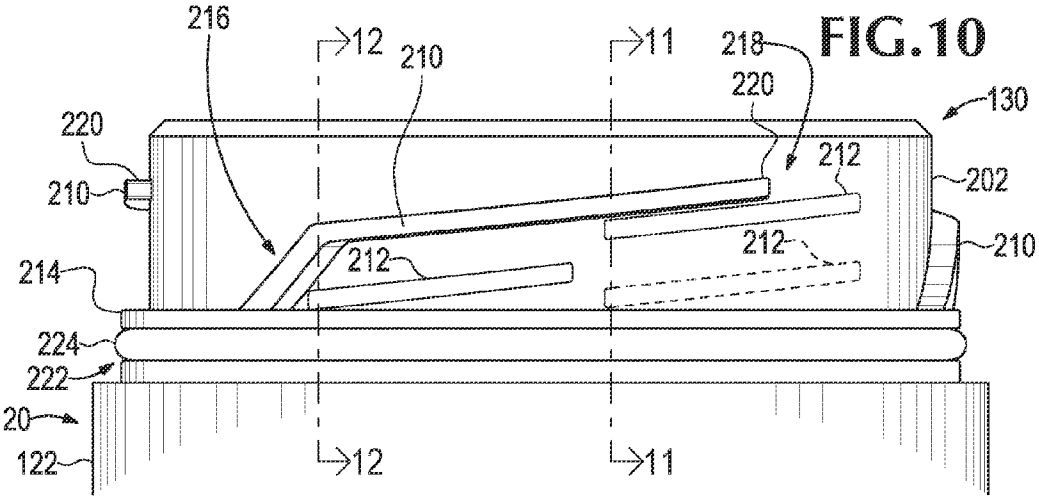
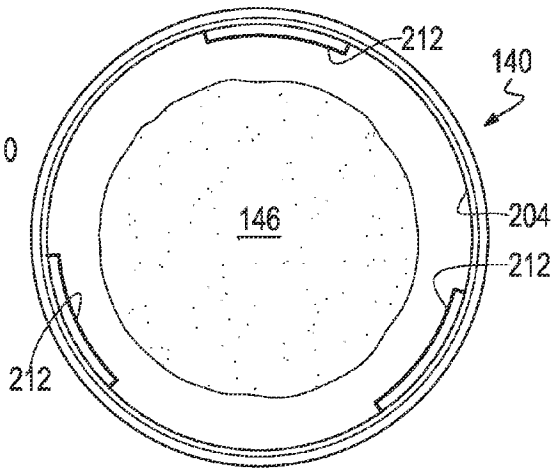
FIG. 9
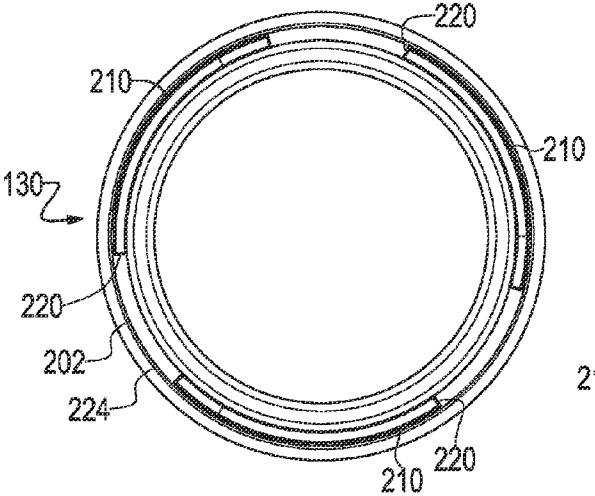
FIG. 8

OPTICAL LENS CASE

CROSS REFERENCE TO RELATED APPLICATIONS

The present application is a continuation-in-part of and claims priority to the subject matter in common with copending Nonprovisional patent application, Ser. No. 12/614,306, filed on Dec. 15, 2010, the complete disclosure of which is hereby incorporated by reference.

TECHNICAL FIELD

The resent invention generally relates to the field of containers for carrying cameras, optical lenses, and other photographic equipment. More particularly, the present invention relates to embodiments of an interchangeable lens canister that affords protection against high impacts, high static force loads, extreme environmental temperatures, and water penetration.

BACKGROUND

Photographic cameras that support interchangeable lenses are the most common used among professional and semi-professional photographers. The ability to change the optical lens mounted to the camera body simply and quickly is the key to the utility of the interchangeable lens/camera system. Because a particular photographic task may require a particular photographic lens design, the user (photographer) can easily change the optical lens of the camera unit to best satisfy the optical requirement for the particular photographic task. Effectively, the interchangeable lens camera system allows the photographer to be able to meet a wide array of photographic tasks with a single camera body (and the correct interchangeable lens unit) as opposed to multiple cameras with fixed lens designs.

Due to the high utility provided by interchangeable lens camera systems, most photographers carry a single camera body and multiple interchangeable lens units to meet a wide array of photographic tasks. It is typical for the advanced photographer to have more money invested in interchangeable lenses than in the individual camera body, since typically camera bodies are replaced or upgraded while optical lenses are kept to meet future photographic needs.

Many camera case designs exist to carry and protect the camera unit and its mounted camera lens. Cases designed to carry individual (unmounted) camera lenses also exist. Most lens cases are either a) rectangular in shape, and/or b) composed of soft or semi-rigid material. Very few lens cases offer protection against high impacts, high static force loads, extreme environmental temperatures, and/or water penetration.

Typically, photographers carry their complete photo kit (camera body, multiple lenses, electronic accessories, etc.) in one large dedicated protective bag or hard case. This system works well in protecting all equipment simultaneously and equally. The downsides to this method for transporting equipment are a) the case or bag makes compromises in protecting each individual piece of equipment, b) it is difficult to make large "photographic" style bags subtle and low-key, c) carrying a large photographic bag prevents the user from carrying other required gear, d) photographic bags may not be adequate for transporting other equipment since they are specialized for a single purpose.

There are many photographers who must be able to carry other equipment into the field. This type of user may include outdoor, adventure, travel, and/or journalistic photographers to name a few. For these users, carrying a large, single-function camera bag is not an option. While on assignment, these users must be able to carry and protect a few pieces of photo equipment (mainly a camera body and spare lenses) and other ion-Photo related equipment in a single bag (backpack, luggage, or similar) designed for multiple purposes, not uniquely designed to transport and protect photographic equipment. These types of photographers do not have the luxury of needing to carry only photo equipment, and thus must accommodate professional and personal gear in their personal luggage.

Lens cases relevant to this disclosure are discussed in the following U.S. Patents, which are hereby incorporated by reference: U.S. Pat. Nos. 4,172,485; 4,177,894; 4,383,565; 5,49,589; 5,199,563; and 5,372,980.

SUMMARY

A dedicated rigid interchangeable lens case allows the photographer to carry a spare interchangeable lens in a single small well-protected package. With a dedicated spare interchangeable lens case, the photographer can have the choice to carry as few or as many interchangeable lenses as they desire. This, in turn, allows the photographer to carry any necessary amount of luggage, rather than a single large photo bag.

Depending on the size of each lens and the size of the interchangeable lens case, either multiple lenses can be stored in a single interchangeable lens case or each lens can be transported in individual smaller interchangeable lens cases. The rigid interchangeable lens case (with lens) can then be stored in personal baggage that does not have to be designed or dedicated to protecting and transporting photographic equipment, thus allowing the user to have more flexibility in baggage and equipment selection. With this dedicated lens case approach the photographer can carry only the protective case(s) he or she needs in a non-dedicated photo bag, yet not compromise on protection of the interchangeable lens unit(s).

Embodiments of an apparatus for receiving and protecting interchangeable camera lenses include a cylindrical body shell, having an outer rigid casing with inner and outer diameters, and having an inner soft-lined receptacle within the inner diameter of the body shell for receiving the camera lens; a base end cap; a ringed shaped mouth member having inner and outer diameters; a lid cap assembly; a first visco-elastic material bonded to the lid cap assembly; a second visco-elastic material bonded to the base end cap; and, the first and second visco-elastic materials conform to the shape of the lens when the lid cap assembly is engaged with the mouth member.

Some embodiments include a lid cap or lid cap assembly that is adapted to be removably engageable in a two-stage rotational interference fit with a mouth member, in which the lid cap is retained thereto. In a first stage of such a rotational interference fit, the lid cap is translatable along the axis of the body shell, with respect to the mouth member, between a non fluid-tight position and a fluid-tight position; and in a second stage of the rotational interference fit, the lid cap is retained in a fluid-tight position.

A set of components suitable for use with embodiments of the lens case apparatus described herein, for example to allow a user to create one or more customized cushioning rings for a lens or other item to be carried within a lens case, may include at least one shock-absorbing stabilizing disk having an outer diameter of a dimension adapted to engage the interior surface of the body shell in a friction fit; and a guide member having concentric circle indicia of different diameters thereon and adapted to be concentrically aligned with the stabilizing disk by means of the circle indicia, the circle indicia including indicia indicating the diameter of the interior surface of the body shell.

The concepts, features, methods, and embodiment configurations briefly described above are clarified with reference to the accompanying drawings and detailed description below.

BRIEF DESCRIPTION OF THE DRAWINGS

Many aspects of the present invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 8 is a top plan view of the cylindrical body shell of the lens case of FIG. 7.

FIG. 9 is a bottom plan view of the lid cap of the lens case of FIG. 7.

FIG. 10 is a partial elevation view of the side of the mouth member, and the upper part of the cylindrical body shell, of the lens case of FIG. 7, and also shows various positions of one of the ridges of the engagement thread arrangement of the lid cap (which is not itself shown) relative to one of the ridges of the engagement thread arrangement of the mouth member.

FIG. 11 is a side plan, partial cross-sectional view of the mouth member and lid cap of the lens case of FIG. 7 engaged in a first stage of a two-stage rotational interference fit, taken along the line 11-11 of FIG. 7.

FIG. 12 is a side plan, partial cross-sectional view of the mouth member and lid cap of the lens case of FIG. 7 engaged in a second stage of a two-stage rotational interference fit, taken along the line 12-12 of FIG. 7

DETAILED DESCRIPTION

Non limiting embodiments of the present invention utilize a lens case that is especially suited to transport and protect optical photographic lenses of various sizes and configurations and provide an alternative to carrying optical lenses in a large semi-rigid or soft dedicated photography bag. The lens case is waterproof and further provides a very high level of protection of its contents from environmental temperatures. In addition, the lens case is designed to protect against static force loads, cushion the lens against impacts, resist high impacts, and prevent unintentional opening of the lens case during its transport or storage.

Figure 1:
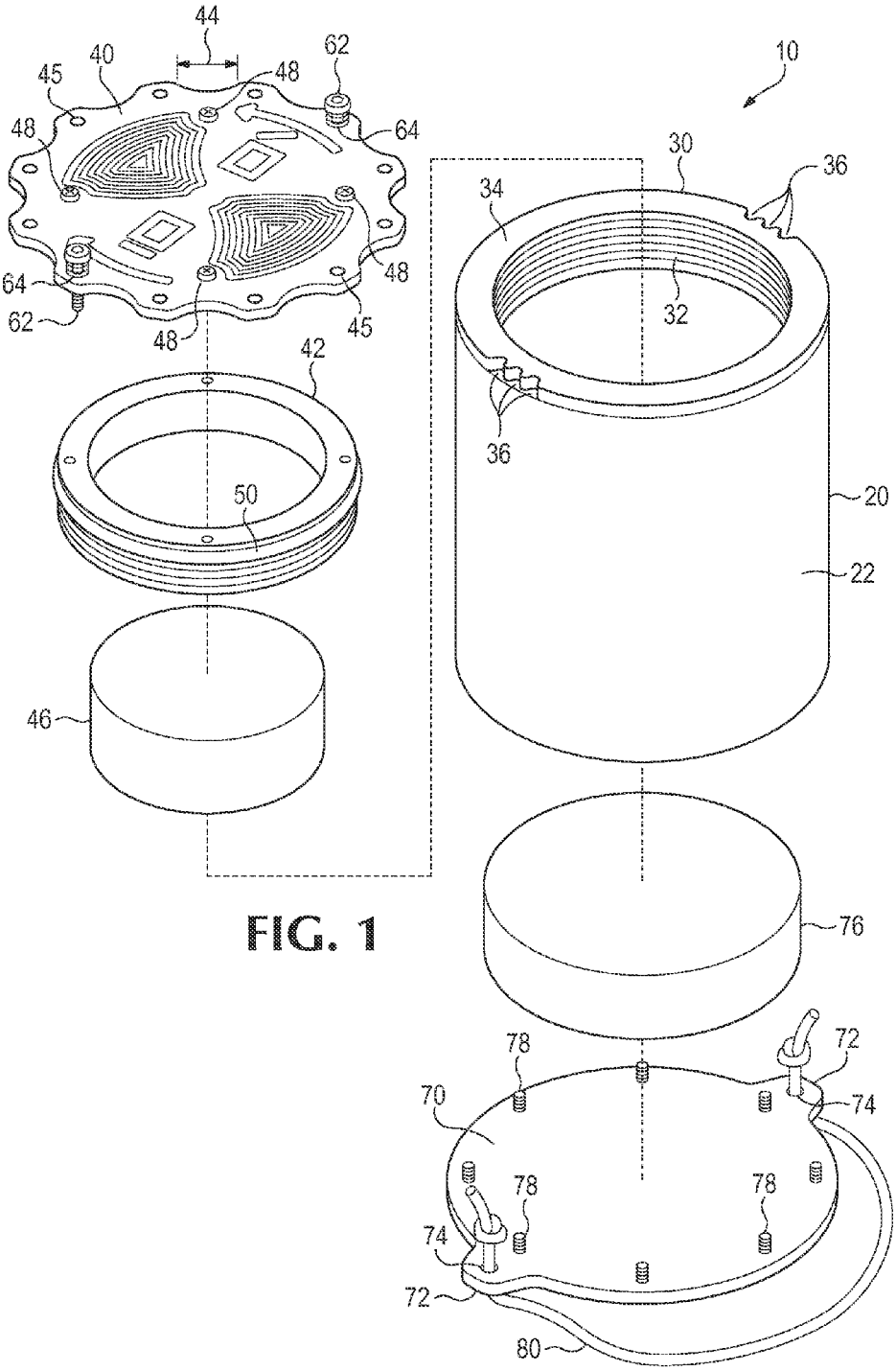
FIG. 1 is an exploded, perspective front view of the lens case constructed according to the teachings of the present invention.

Referring to the drawings, wherein like reference numerals represent like parts throughout the various drawing figures. FIG. 1 is directed to a lens case or canister 10. The lens case 10 has a body shell 20, a ring-shaped mouth member 0, a lid cap assembly gasket 50, lid lock assembly 60, base end cap 70, and strap 80.

Figure 5:
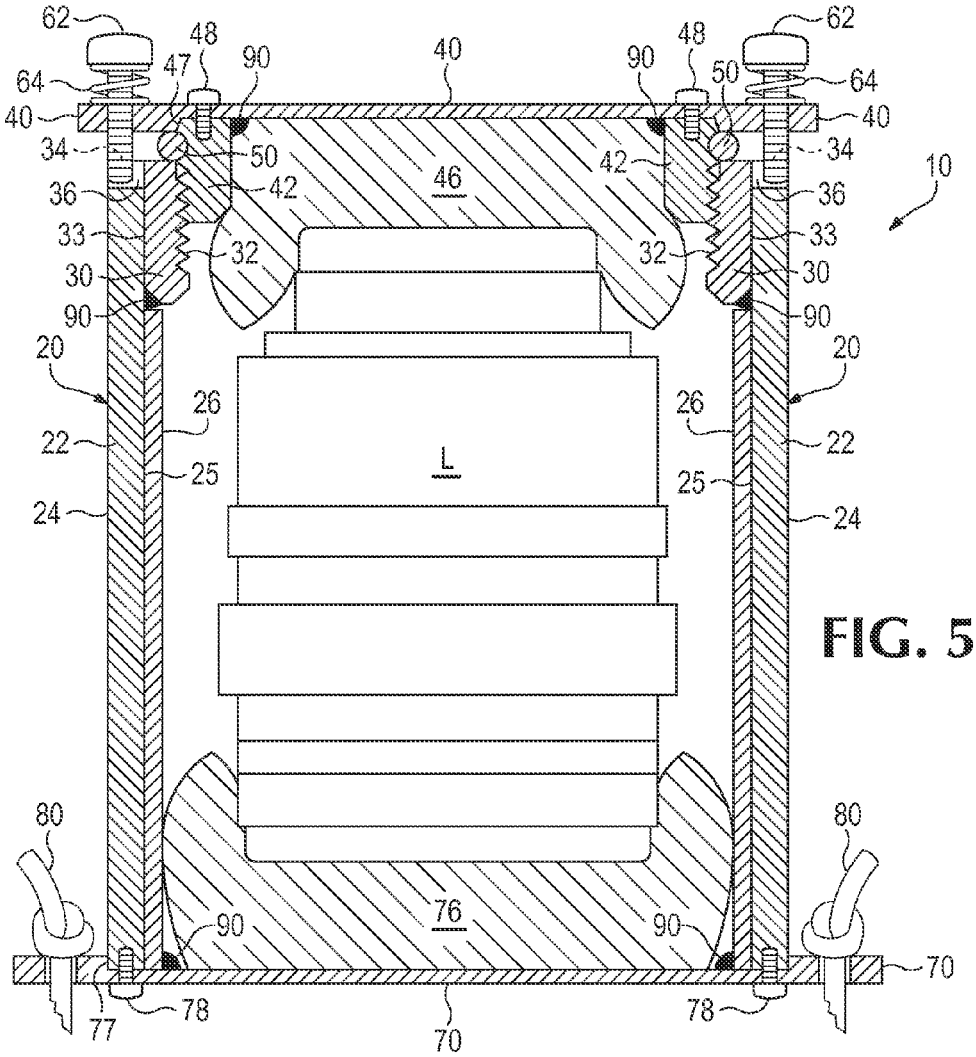
FIG. 5 is a side plan, cross-sectional view of the lens case shown in FIG. 1.
Figure 6:
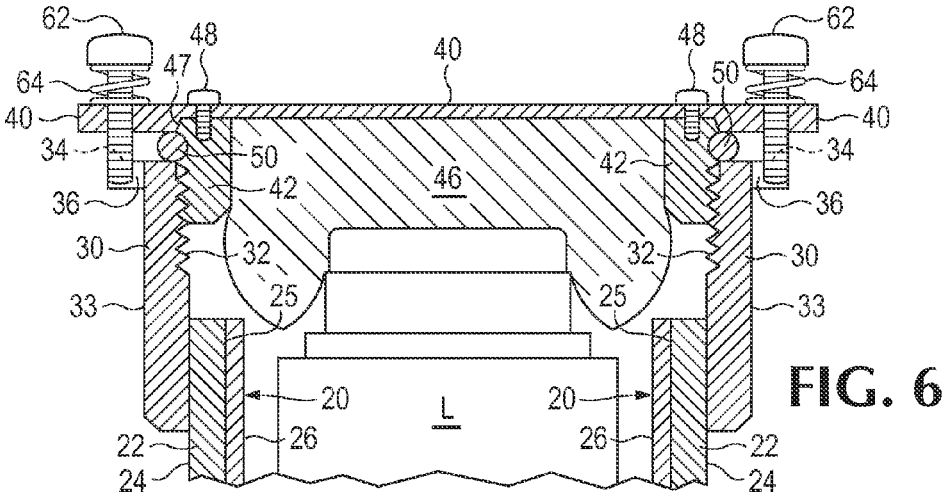
FIG. 6 is a side plan, cross-sectional view of a non-limiting embodiment of the lens case.

With reference to FIGS. 5 and 6 and continuing reference to FIG. 1, body shell 20 is a cylindrical tubing canister that has an outer rigid casing 22 and inner liner 26. Outer rigid casing 22 has external surface 24 and internal surface 25. Outer rigid casing 22 can be constructed from a cylindrical ABS tube that is cut to length to accommodate interchangeable lenses L with variable external lengths and external diameters. Various internal cavity diameters of the outer rigid case ranging from about 3 to about 4 inches can be used to accommodate lenses with complementary external diameters. In this disclosure, the external diameter of the lens is referred to as a lens diameter.

It should be understood by one of ordinary skill in the art that the outer rigid casing 22 can be constructed from any other suitable rigid material that is durable, tough, water-resistant, and relatively lightweight. Such materials include, but are not limited to, injection molded plastic, carbon fiber resin, or other metal or non-metallic alloy.

External surface 24 and the internal surface 25 of the outer rigid casing 22, as well as the inner liner 26 are shown, in the non-limiting configurations of FIGS. 5-6. In the example shown in FIGS. 5 and 6, inner liner 26 extends from mouth member 30 to base end cap 70. Grit-impregnated synthetic self-adhesive tape (not shown) may be attached to the external surface 24 to provide a firm grip of the lens canister 10. Those of skill in the art will appreciate that any suitable material alternative is contemplated as being within the spirit and scope of the invention.

With continuing reference to FIGS. 5 and 6, inner liner 26 abuts internal surface 25 to form a soft-lined receptacle in which to receive the lens L. The inner liner 26 can be made from a thin, soft, and durable material, such as, but not limited to, Neoprene®. The inner liner 26 protects the external surface of the transported interchangeable lens L from damage upon entry into and exit from the lens case 10. Inner liner 26 may also assist in dampening impacts to the lens case 10 during transport or storage. However, in some examples, such as shown in FIGS. 5 and 6, the inner liner may not contact the lens when the lens is stored in the lens case, but instead the lens case may provide for a gap of air around the lens for at least a portion of the height of the lens. The inner liner 26 may be removable for cleaning or replacement.

Referring back to FIG. 1, mouth member 30 is ring-shape and constructed from injection, molded and machined acrylic plastic. Those of skill in the art will appreciate that any suitable material alternative is contemplated as being within the spirit and scope of the invention. The mouth member 30 has grooves 32, a flange 4 and stop notches 36. The ring-shaped mouth member 30 is permanently bonded via epoxy 90 or cement 90 (See FIGS. 5 and 6) to the outer rigid casing 22, as shown in FIG. 1. A permanent adhesive bond with epoxy 90 or cement 90 is used to guarantee a water-tight seal, as well as to ensure a robust structure of the lens case 10.

In FIGS. 5 and 6, outer diameter 33 of the mouth member 30 is illustrated. The mouth member 30 at outer diameter 33 can be bonded to the internal surface 25 of the outer rigid casing 22, as shown in FIG. 5. Alternatively, in a non-limiting embodiment, the outer diameter 33 of the mouth member 30 can be bonded to the external surface 24 of the outer rigid casing 22 of the body shell 20, as shown in FIG. 6. Smaller in external diameter interchangeable lenses L will be suited for the embodiment of FIG. 6 with the mouth member 30 adhesively bonded to the external surface 24 of the outer rigid casing while a lens L with a longer external diameter can be used for the embodiment as represented in FIGS. 1-5.

Figure 2:
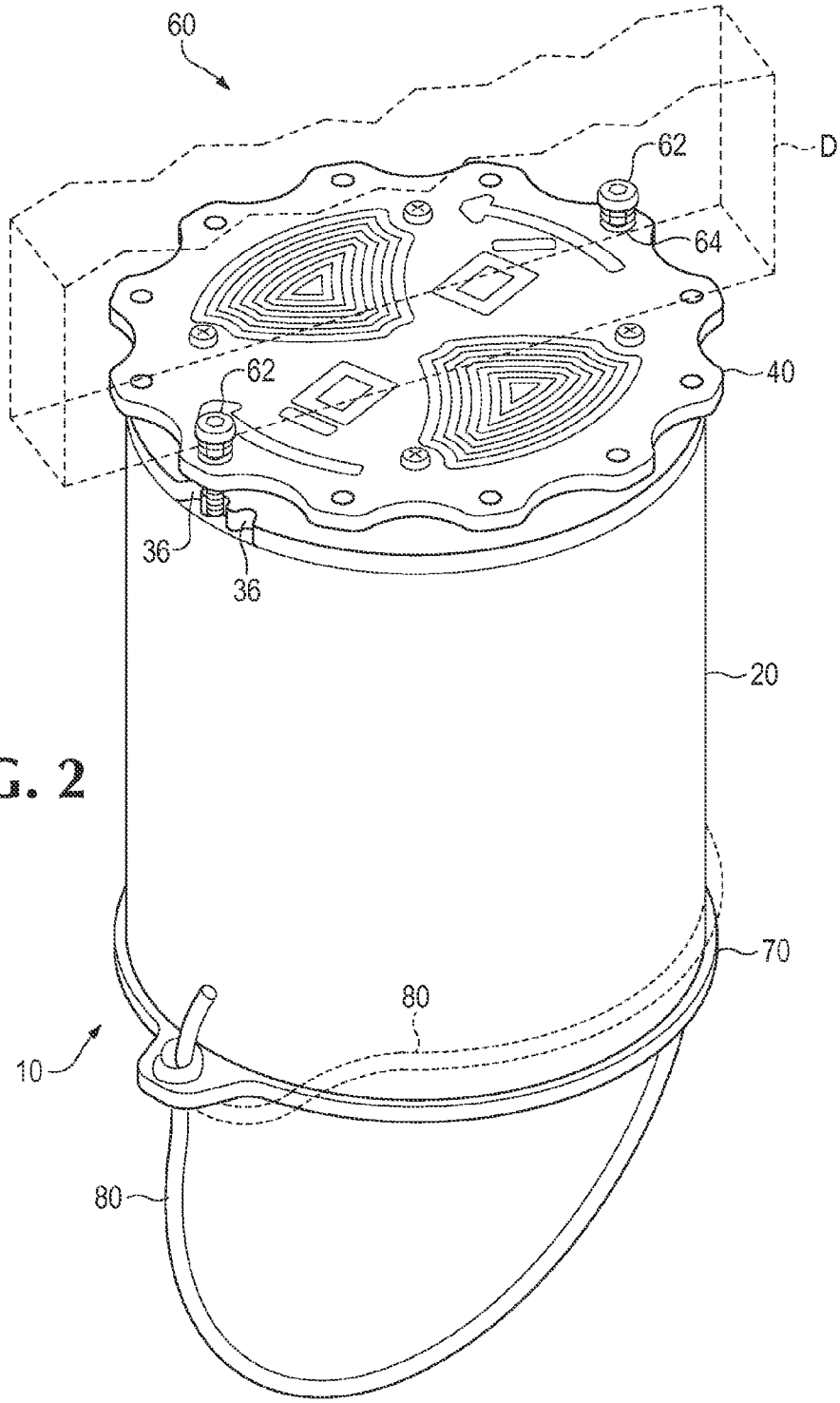
FIG. 2 is a perspective front view of the lens case shown in FIG. 1.
Figure 3:
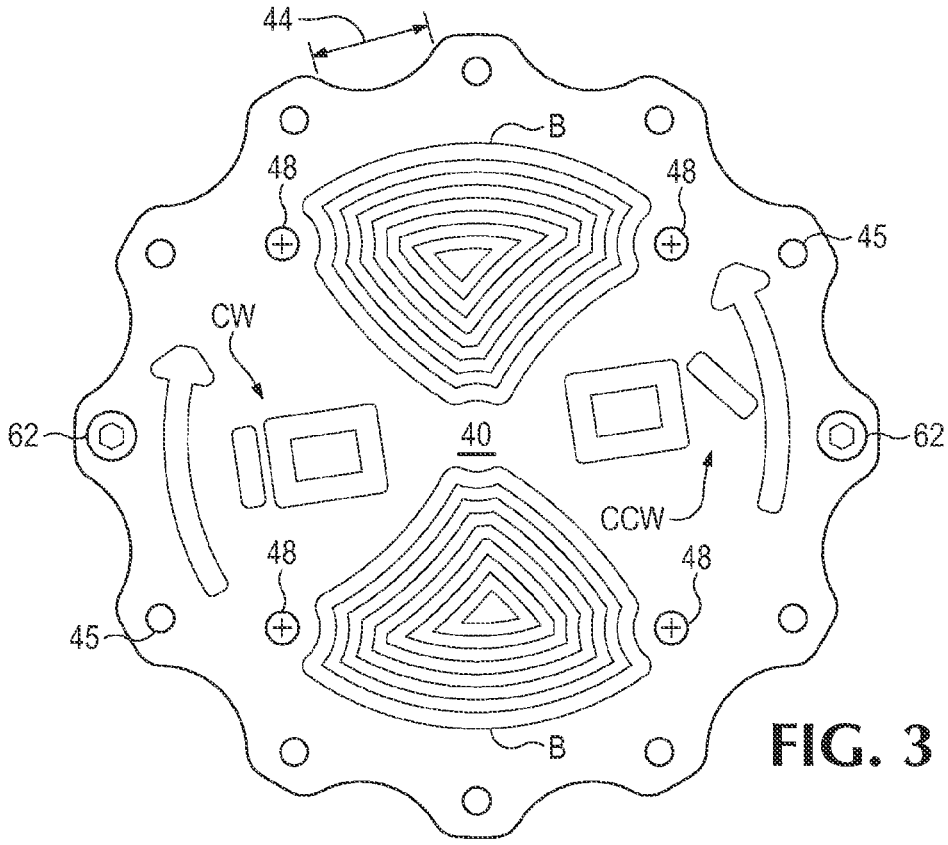
FIG. 3 is a top plan view of the lens case shown in FIG. 1.

Referring to FIGS. 1, 2 and 3, the lens canister 10 includes a lid cap assembly 40. The lid cap assembly 40 has a thread ring 42, cut-outs 44, holes 45, visco-elastic material 46, and fasteners 48. The lid cap assembly 40 is machined from a plastic material, in particular 0.25 inch thick ABS sheet, and has a disk-like circular shape. The lid cap assembly may be formed from a variety of other materials in different examples, such as other types of plastic, metals, or ceramics. The perimeter of the lid cap assembly 40 has semi-circular cut-outs 44 that enable a user to easily rotate the lid cap assembly 40 when closing or opening the lens case 10.

In addition, the top side of the lid cap assembly 40 may employ various machined markings or etchings B, CW, and CCW. In a non-limiting embodiment of FIG. 3, markings B define a concentric pattern that increases the friction available for a user's finger to engage and manipulate the lid cap assembly, marking CW with arrow designates the functional rotation direction to close the lid case 10, and marking CCW with arrow designates the functional rotation direction for opening the lens case 10. Additional and alternative, markings may be used for product branding, as shown in a non-limiting embodiment of FIG. 4.

The thread ring 42 of the lid cap assembly 40 is constructed from injection molded and machined acrylic plastic. Those of skill in the art will appreciate that any suitable material alternative is contemplated as being within the spirit and scope of the invention. The underside of the lid cap assembly has a circular pocket 47 to accommodate the bonding and assembly of the thread ring 42.

The lid cap assembly 40 including the thread ring 42 are permanently bonded with epoxy 90 and reinforced with fasteners 48. In a non-limiting embodiment, the fasteners 48 in FIGS. 1-6 are stainless steel screws. It should be understood by one of ordinary skill in the art that fasteners 48 can any other suitable material used to reinforce the types of materials used in the present invention.

Referring to FIGS. 5 and 6 and with continuing reference to FIG. 1, gasket 50 is illustrated. The gasket 50 may be an O-Ring made from EPDM rubber. Those of skill in the art will appreciate that any suitable material alternative is contemplated as being within the spirit and scope of the invention. Thread ring 42 may be slotted such that the gasket 50 is stationary to the thread ring 42. The gasket 50 ensures that a water and air-tight seal is formed within the rigid lens case 10 when the thread ring 42 of the lid cap assembly 40 is engaged with the grooves 32 of the mouth member 30.

When the lid cap assembly 40 is engaged with the mouth member 30, the lid cap assembly 40 may be rotated to the dosed position, compressing the gasket 50 against the external surfaces of the lid cap assembly 40 and the mouth member 30, as shown in FIG. 2. The threaded interface between the lid lap assembly 40 and the mouth member 30 provides a rotational interference fit allowing the user to open and close the lens case 10 using a twisting motion. A clockwise (CW) direction closes the case, and a counterclockwise (CCW) direction opens the case.

The mouth member 30 captures the lid cap assembly 40 with a rotational motion provided by the user. As the user rotates the lid cap assembly 30 clockwise, the lid cap assembly 30 will translate downward, towards the body shell 20 until the gasket 50 is adequately compressed and the lens case 10 is closed. The flange 34 provides a smooth surface for the gasket 50 to sit and seal, via compression from the downward translation of lid cap assembly 30. As a result, a water-proof seal between the interior and exterior of the lens case 10 is created.

With continuing reference to FIG. 2, the lens case 10 provides a high level of protection to optical lenses L from the ambient environment that exceeds existing soft or semi-rigid cases. The types of protection provided include water and moisture penetration, and thermal temperature changes.

Referring to FIGS. 1, 2, 3, 5, and 6, the lid lock assembly 60 is composed of a pair of socket head machine screws 62 and compression springs 64. The machine screws 62 are threaded thru the lid cap assembly 40. Once the lid cap assembly 40 is rotated clockwise and the lens case 10 is closed, the machine screws 62 are then twisted clockwise to engage the matting set of stop notches 36 on the flange 34 of the mouth member 30. The stop notches are recessed portions cut out of the flange 34 such that the periphery of the ring shaved mouth member 30 is riot truly annular. Each set of the stop notches 36 is positioned 180 degrees from the other set 36.

With the machines screws 62 acting as biasing members and engaged into the stop notches 36, the lid cap assembly 40 is restricted or prevented from rotating in a counter clockwise direction, thus locking the lid cap assembly 40 in the closed position. Compression springs 64 are mounted axially around the body of the machine screw 62, applying a load on the back side of the head of the machine screw 62. As a result, the springs 64 prevent the screws 62 from backing out and off from the lid assembly 40.

In a non-limiting embodiment of FIG. 2, the lid lock assembly 60 can be used to aid in removing an overly tightened or jammed lid cap assembly 40, when pressure and temperature changes make opening the lens case 10 more difficult. A can be seen in FIG. 2, machine screws 62 are spaced and offset from a line extending between them. Offset in this context means that machine screws 62 are on opposite lateral sides of the imaginary line extending between them.

As shown in FIG. 2, rotational leverage can be gained to help unscrew an overly tight, air locked, or jammed lid cap assembly 40 by wedging a sturdy straight edge or fixture D, such as the end of a desktop or table top the machine screws 62, between the edges of machine screws 62. Expressed another way, machine screws 62 are positioned to receive and cooperatively abut on opposing lateral sides a straight edge extending along tale line between them to provide rotational leverage for removably engaging the lid cap assembly. The lid lock assembly 60 is also designed such that it can easily be removed by the user if desired.

Figure 4:
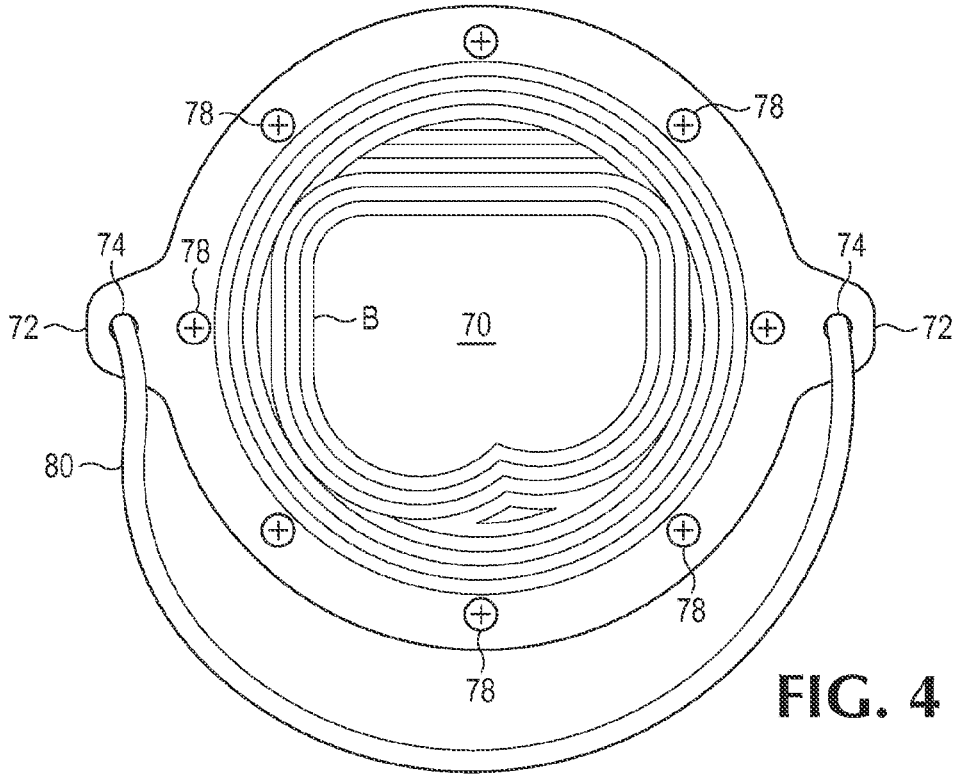
FIG. 4 is a bottom plan view of the lens case shown in FIG. 1.

Referring to FIGS. 1, 4, and 5, the base end cap 70 is illustrated. The base end cap 70 is constructed from machined 5052 aluminum plate, ABS, or acrylic materials, and has a disk like circular shape. Base end cap 70 forms a closed-end, floor with the body shell 20. The perimeter of the base end cap 70 is circular with the exception of two protruding tabs 72 that enable the user to get a better grasp of the lens canister 10 when removing or replacing the lid cap assembly 40. Through holes 74 serve as attachment points to strap 80 (described below).

Similar to the lid cap assembly 40, the external surface of the base end cap 70 may include various machined markings B, as shown in FIG. 4. The internal side of the base end cap has a circular pocket 77 to accommodate the bonding and assembly to the body shell. 20. The base end cap 70 is permanently adhesively bonded to the body shell 20 with epoxy 90 and additionally fixed with fasteners 78, such as stainless steel screws. The protruding heads of the fasteners 78 also help protect the external surface of the base end cap 70.

Referring to FIGS. 1 and 5, both the lid cap assembly 40 and the base end cap 70 include visco-elastic material or polyurethane foam, conventionally known as memory foam. In FIGS. 1 and 5, visco-elastic material 46 is bonded to the lid cap assembly 40 and visco-elastic material 76 is bonded to the base end cap 70. Both visco-elastic materials 46 and 76 perform the same function, and have the same purpose. The correct thickness sizing of visco-elastic materials 46 and 76 is necessary to properly suspend an optical lens L in the rigid lens case 10.

In the examples shown in FIGS. 1 and 5, visco-elastic material 46 is selected to have a volume sufficient for portions it to extend into the gap around the lens a distance sufficient to fully overlie mouth member 30 when lid cap assembly 40 is mounted to body shell 20 and visco-elastic material 46 conforms to the shape of the lens. By partially extending into the gap, visco-elastic material 46 serves to retain the lens in a central position. By overlying mouth member 30, visco-elastic material 46 shields the lens from impact with mouth member 30.

By nature, the visco-elastic materials 46 and 76 are very compliant. Thus, a single foam thickness will cover a relatively large set of lens L dimension. In addition, for encasing optical lenses L that are shorter in length (See FIG. 5), additional visco-elastic materials, as well as additional foam disks of different densities are provided to the user. It should be appreciated by one of ordinary skill in the art that any extra foam material provided with the lens case 10 can include a different type of foam, such as closed cell polyethylene (not shown) to provide protection against impact and vibrations when used in conjunction with visco-elastic materials 46 and 76. When multiple types of foam are used in a layered series, there is combined advantage because the visco-elastic materials 46 and 76 grab and contour to the end of the lens L, while the more rigid polyurethane layer (not shown) provides more resilient damping against the transmission of large impacts.

The visco-elastic materials 46 and 76 are composed of a 1-2 inch thick circular piece of visco-elastic polyurethane foam. The properties of this specific type of polyurethane foam enable the carried lens L to be very well isolated from shock and vibrations applied to the lens case 10.

When the lens case 10 is completely closed, the soft visco-elastic materials 46 and 76 compress against and around the top and bottom end of the lens L. Both materials 46 and 76 mold to the external end shape of the stored optical lens L, thus suspending the lens L and preventing any lateral or side-to-side movement of the lens L within the case 10. Visco-elastic materials 46 and 76 alleviate the need for lens L manufacturers to include custom foam supports that are specifically made for their commercially available lenses L. The lateral sides of the lens L are held away from the sides of the lens case 10 where there is a higher likelihood of external impact forces or static loads. Also, placement and removal of the lens L in and out of lens case 10 is fast and easy, since the user does not have to be concerned with bulky foam padding or it foam materials along the lateral sides of the lens case 10.

The visco-elastic materials 46 and 76 suspend the lens L at the lens' L strongest points (i.e., the front end of the lens L and the mounting point to the camera body), forming a pocket of air (not shown) around the outer surface of the lens L. The pocket of air further inhibits moisture from reaching the lens L because there is no material for moisture to wick through. Also, the pocket of air contributes positively to thermally insulating the lens L, since air is such a good insulator. Providing a pocket of air facilitates storing a wider variety of lens L, e.g. some lenses L may have projections or bulges along their length with which padding would interfere.

With reference to FIGS. 1, 2, 4, and 5, strap 80 is attached to the base end cap 70 at through holes 74. The strap 80 can be constructed of elastic or non-elastic cord. The strap 80 allows the user to more securely the lens case 10 by hand or remove the case 10 from a backpack or any other baggage with ease. The strap 80 can be stored in a configuration around the base end cap 70 when not in use, as shown by the phantom lines in FIG. 2.

In a non-limiting embodiment, the strap 80 may be stretched over (not shown) the lid cap assembly 40 to further compress the lid cap assembly 40 to the body shell 20. In this non-limiting embodiment, strap 80 extends taut along the length of the lens case when stretched over the top of the lid cap assembly 40 and can serve as a handle during transport.

An illustrative example of an alternate closure arrangement between the mouth member and the lid cap is shown in FIGS. 7-12 and described in the following paragraphs. Briefly, the lid cap and the mouth member of a lens case, in the alternate closure arrangement, are configured to be removably engageable in a two-stage interference fit. In the first stage of the two-stage interference fit, the lid cap is retained against the mouth member, but is translatable in a limited range of movement along the axis of the cylindrical body shell between a non fluid-tight position and a fluid-tight position. In the second stage, the lid cap is retained in a fluid-tight position. As will be appreciated, this type of interference fit may provide a user with a pressure-equilibrating option—specifically, between the air inside the lens case and the ambient air—while still protecting a lens stored inside the case, as well as a fluid-tight option (in which the air inside the lens case is sealed from the ambient environment).

A pressure-equilibrating option may be advantageous in some circumstances, such as might arise from the effects of different air pressures on a fluid-tight threaded closure. For example, it may be quite difficult to remove a threaded lid cap if the air pressure inside a container is, or has become, higher than the ambient air pressure, which may occur if the threaded closure is sealed at a low altitude location and then taken to a high altitude location. In such a case, the comparatively higher air pressure it the container may exert an upward force on the threaded lid cap, requiring a user to apply what may be a considerably greater rotational force then normal in order to break the friction lock of the threaded closure.

However, a lens case that features the alternate closure arrangement described below, for example when the lid cap is engaged with the mouth member in the first stage of the two-stage interference fit, may avoid this requirement. In the circumstances described above, for example, in which a lid cap is engaged with the mouth member in a fluid-tight position of the first stage of the two-stage interference fit, a comparatively higher air pressure inside the lens case would translate the lid cap away from the mouth member to a non fluid-tight position, at which point pressure equilibration between the inside of the lens case and the ambient air would occur, while still retaining the lid cap to the mouth member in a manner that would not require additional effort to disengage, as might be the case with a standard, or non pressure-equilibrating, rotational fit.

Figure 7:
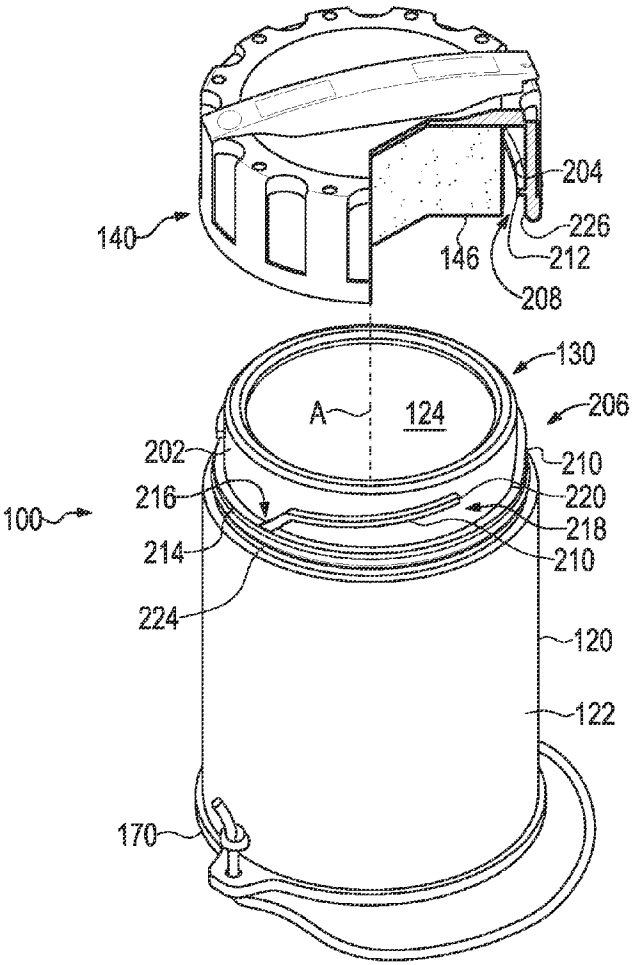
FIG. 7 is a perspective front view of a lens case constructed according to the teachings of the present invention, and featuring an illustrative example of an alternate closure arrangement between the mouth member and the lid cap to that shown in FIG. 1, with a portion of the lid cap cut away to reveal internal structure.

FIG. 7 shows a lens case or canister 100 featuring one illustrative embodiment of the alter late closure configuration briefly described above. Similar to lens case 10 as shown FIGS. 1-6, lens case 100 includes a cylindrical body shell 120, a ring-shaped mouth member 130, and a lid cap 140.

Except where indicated in the paragraphs below, components of the lens case 100, such as body shell 120, mouth member 130, lid cap 140, etc. may be assumed to have configurations and characteristics consistent with corresponding components of lens case 10. For example, body shell 120 includes an outer rigid casing or wall 122 and a soft-lined interior surface 126, and a base end cap 170 positioned at a bottom end to form a closed-end floor that includes a visco-elastic material (not shown) disposed thereon; mouth member 130 forms an opening sized to receive a camera lens; lid cap 140 includes a visco-elastic material 146 disposed to extend into the body shell when the lid cap is engaged with the mouth member, and so forth. As such, the following explanation assumes, but does not repeat the foregoing explanation of the form and function of the components already discussed.

In FIG. 7, mouth member 130 and lid cap 140 each include respective mating surfaces, indicated at 202, 204. In the example embodiment shown and illustrated herein, the mouth member 130 assumes a male configuration, and thus the mating surface 202 is an outward-facing (or outer) annular surface, whereas lid cap 140 assumes a female configuration, with its mating surface 204 shown as an inward-facing (or inner) annular surface configured to receive the outer annular surface 202. However, it will be appreciated that this configuration may be reversed, without departing from the scope of this disclosure.

Each mating surface includes an engagement thread arrangement 206, 208 disposed thereon. Specifically, in the embodiment of the lens case shown at 100, each engagement thread arrangement consists of a series of three non-overlapping ridges 210, 212 that each protrude from and extend partway around the respective mating surfaces 206, 208.

With additional reference to FIGS. 8-10, it can be seen that mouth member 130 includes an annular ledge 214 disposed generally downward of its engagement thread arrangement 206. Alternately, ridges 210 can be thought of as extending generally upward, at an inclined orientation, relative to the ledge 214. In particular, in the illustrated embodiment, each ridge 210 is shown to have a proximal or lower portion 216 that inclines upward from the ledge at a first angle, and a distal or upper portion 218 that inclines upward at a second, lesser angle, terminating in an upper end 220. Ledge 21 defines the upper bound of a channel 222 formed in the mating surface 202, in which is seated a peripheral gasket 224.

As explained in greater detail below, the complementary mating surface 204 of the lid cap 140 includes a sealing surface 226 disposed to selectively, sealingly engage the peripheral gasket to form a fluid-tight closure therewith.

With reference to FIGS. 8 and 9, it can be seen that the corresponding ridges 212 of the complementary engagement thread arrangement 208 on the mating surface 204 of the lid cap 140 are of a length that allows the ridges of the respective thread arrangements to become engaged—specifically, the upper ends 220 of the ridges of the mouth member 130 are radially spaced from each other by a distance greater than the length of the ridges 212, allowing the ridges of the lid cap to fit between the upper ends of the ridges of the mouth member in order to be rotationally engaged. Moreover, the radial symmetry of both thread arrangements allows the engagement thereof in a lumber of relative orientations of the lid cap to the mouth member—specifically, because each thread arrangement of the illustrated embodiment is shown to include three complementary ridges, the lid cap may rotationally engage the mouth member in any of three orientations, such as for ease of closing the lens case. As such, it is evident that the thread arrangements may include any number of ridges.

With the foregoing description in mind, and with reference to FIGS. 10-12, the engagement of the lid cap 140 with the mouth member 130 in the two-stage rotational interference fit is fairly straightforward. FIG. 10 shows the upper portion of body shell 120, including mouth member 130 and the engagement thread arrangement 206 disposed on the mating surface 202 thereof, and also shows one ridge 212 of the lid cap 140 (not shown) superimposed in three different example positions relative to one ridge 210 of the mouth member 130.

FIG. 11, which is a cross-sectional view along the line 11-11 of FIG. 10, shows the relative arrangement of various components of the mouth member 130 relative to the ridge 212, and also shows lid cap 140, for context. FIG. 11 represents the lid cap and mouth member in a first stage of the two-stage rotational interference fit, for example after the lid cap has been placed on the mouth member in such a manner as to align the ridges for rotational engagement, and the lid cap has been rotated relative thereto so the ridges are engaged. In the first stage of the interference fit, the lid cap is translatable in a limited range of movement, represented by arrow B, relative to the mouth member. The range of movement is defined, in the illustrated embodiment, by the distance between ridge 210 and ledge 214, through which beige 212 is movable. In particular, in the illustrated embodiment, it can be seen that in the lower limit of the range of movement, which is represented by ridge 212 and sealing surface 226 in dashed lines, the ridge 212 abuts the ledge 214, preventing further downward movement, and the sealing surface 226 sealingly engages peripheral gasket 226. As such, the lower limit of the range of movement is a fluid-tight position. Upward translation of the lid cap from this position results in the sealing surface 226 disengaging the peripheral gasket, at which point the engagement is non fluid-tight. Further upward movement is prevented when ridge 212 abuts ridge 210.

Of course, the relative configurations of the complementary engagement thread arrangements may be varied from that illustrated, such as to provide a movement range of a desired size. For example, a more limited range of movement could be achieved by increasing the width of one or more of the ridges and/or raising the position of the ledge, and so forth. Moreover, as shown, due to the inclined orientation of the ridges 210 of the mouth member, the range of permitted translatable movement along the axis A of the body shell decreases as the ridge 212 is rotated further toward the proximal region 216 of the ridge 210. At each point, however, the lower limit of the movement range corresponds to a fluid tight position as the sealing surface 226 sealingly engages the peripheral gasket 224, whereas an upper position, in which the sealing surface 226 does not engage the peripheral gasket 224, corresponds to a non fluid-tight position. A different orientation of the ridges 210, of course, may result in different areas having different ranges of movement.

In the illustrated embodiment, further rotation of the lid cap relative to the mouth member will ultimately result in the orientation shown in FIG. 12, which is a cross-sectional view along the line 12-12 of FIG. 10, representing a second stage of the two-stage rotational interference fit. In the second stage, in which the ridge 212 of the lid cap is wedged between the proximal portion 216 of ridge 210 and the ledge 214, the sealing surface 226 sealingly engages the peripheral gasket 224, and the lid cap is retained in a fluid tight position.

From the foregoing description it should be apparent that modifications can be made to the components of lid cap 140 and mouth member 130 to achieve a two-stage rotational interference fit consistent with that described above. For example, it is not required for all embodiments to include a peripheral gasket and sealing surface, as other suitable methods of achieving a fluid-tight fit between rotationally engageable mating surfaces may be employed. In embodiments that do include a peripheral gasket and sealing surface, such components may be disposed, respectively, on the mouth member and lid cap, or vide versa, and may be positioned as desired on the mating surfaces thereof. As noted above, the ridge configuration of each threaded arrangement may be modified to still achieve a two-stage rotational interference fit substantially as described above, and so forth.

Figure 13:
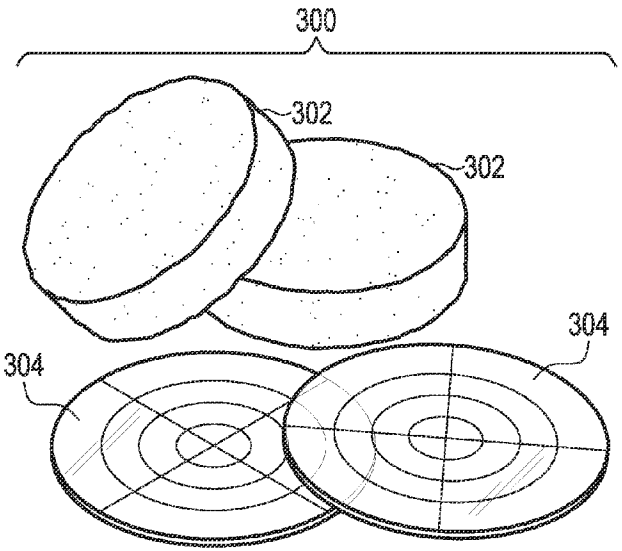
FIG. 13 is a perspective front view of two stabilizing disks and two guide members which feature an illustrative example of additional components that a user may selectively employ to securely store a camera lens within a lens case.

Regardless of the configuration of the closure arrangement or lens case, commercial embodiments may be supplied with additional components that a user may selectively employ to assure secure storage of a camera lens for other object) within a lens case constructed according to the present disclosure. An example set 300 of such components is illustrated in FIG. 13, which shows two stabilizing disks 302 and two guide members 304. In commercial embodiments, set 300 may be offered to consumers as an additional, separate kit for use with a particular size of lens case, or may be bundled as a kit with a lens case, and so forth, according to desired commercial practices. Essentially, the example set 300 may allow a user to create a pair of customized cushioning rings that may be applied to the lens or other item prior to inserting the item in the lens case.

The stabilizing disks 302 thus may each have an outer diameter sized to fit within a lens case, and may be fabricated of a substantially rigid, yet deformable, shock-absorbing material, such as any of several polyurethane foams. Optionally, a set may include several pairs of stabilizing disks, for example having different outer diameters, thicknesses, and/or being fabricated of materials having different characteristics, for example to provide a user a variety of components from to create a customized ring.

Guide members 304, which may be in the form of adhesive decals or otherwise, are shown to be substantially transparent, but to also include concentric circle indicia marked thereon. Although other configurations are possible, guide members 304 are shown to have a slightly greater outer diameter as the stabilizing disk, as explained below.

In one example use of the set 300, a user may create a pair of customized cushioning ring for a camera lens or other item as follows: the item may be centered in a lens case, such as lens case 10 or 100, and then a guide member 304 may be placed or adhered lightly to the top rim of the lens case. The user may then trace the outline of the item on the surface of the guide member, remove the traced guide member, and then remove the item from the lens case. The item may then be turned over, replaced back in the lens case, and the second guide member may be used in a similar manner to record a second outline of the item.

Each guide member may then be centered on one of the stabilizing disks, and the user may cut each outline out of the center of each stabilizing disk to create a pair of cushioning rings sized to respectively fit both ends of the item. The cushioning rings may be placed on the item, which may then be placed into the lens case. In this manner, lateral movement of the item inside the lens case may be further restricted, by using the customized cushioning rings to maintain a spaced relationship between the item and the interior surface of the lens case.

From the foregoing description it will be apparent that modifications can be made to the protective lens case 10, or 100, or set 300, or to the various components and configurations thereof, without departing from the teachings of the invention.

The instant invention may be embodied in other forms or carried out in other was without departing from the spirit or essential characteristics thereof. The present disclosure is therefore to be considered as in all respects illustrative and not restrictive, the scope of the invention being indicated by the appended claims, and all equivalency are intended to be embraced therein. One of ordinary skill in the art would be able to recognize equivalent embodiments of the instant invention and be able to practice such embodiments using the teaching of the instant disclosure and only routine experimentation.

What is claimed is:

1. An apparatus for receiving and protecting interchangeable camera lenses comprising:

a cylindrical body shell having a rigid wall with a soft-lined interior surface, a base end cap positioned at a bottom end of the body shell to form a closed-end floor, and a mouth member disposed at a top end thereof to form an opening sized to receive a camera lens; and a lid cap that is removably engageable in a two-stage rotational interference fit with the mouth member, in which the lid cap is retained thereto;

wherein in a first stage of the rotational interference fit, the lid cap is translatable along the axis of the body shell, with respect to the mouth member, between a non fluid-tight position and a fluid-tight position; and wherein in a second stage of the rotational interference fit, the lid cap is retained in a fluid-tight position.

2. The apparatus of claim 1, wherein in a fluid-tight position a sealing surface on one of the mouth member and lid cap sealingly engages a peripheral gasket disposed on the other of the mouth member and lid cap.

3. The apparatus of claim 2:

wherein the sealing surface and peripheral gasket are disposed on respective mating surfaces on the mouth member and lid cap;

wherein the mating surfaces also each include complementary engagement thread arrangements having two or more non-overlapping ridges each protruding from and extending partway around the respective mating surface; and wherein the ridges of one of the engagement thread arrangements are at least partially inclined and include upper ends that are spaced from each other by a distance greater than the length of the ridges of the other of the engagement thread arrangements.

4. The apparatus of claim 2, wherein the sealing surface is disposed on an inward-facing mating surface of the lid cap, and the peripheral gasket is disposed on an outward-facing mating surface of the mouth member.

5. The apparatus of claim 1:

wherein one of the mouth member and the lid cap assumes a male configuration that includes an outer annular mating surface, and the other of the mouth member and the lid cap assumes a female configuration that includes an inner annular mating surface configured to receive the outer annular mating surface;

wherein each mating surface includes an engagement thread arrangement disposed thereon; and wherein the rotational interference fit is accomplished by rotationally engaging the respective engagement thread arrangements.

6. The apparatus of claim 5, wherein the respective engagement thread arrangements permit the lid cap to be engaged with the mouth member in any of a number of relative orientations thereof.

7. The apparatus of claim 6, wherein each engagement thread arrangement includes two or more ridges each protruding from and extending partway around the respective mating surface, with the ridges of one of the engagement thread arrangements being at least partially inclined and including upper ends that are spaced from each other by a distance greater than the length of the ridges of the other of the engagement thread arrangements.

8. The apparatus of claim 7, wherein the number of relative orientations corresponds to the number of the two or more ridges of each engagement thread arrangement.

9. The apparatus of claim 5, wherein the mouth member assumes the male configuration and wherein the lid cap assumes the female configuration.

10. The apparatus of claim 9, wherein each engagement thread arrangement includes two or more ridges each protruding from and extending partway around the respective mating surface, with the adjacent ridges of the engagement thread arrangement of the mouth member being at least partially inched and including upper ends that are radially spaced from each other by a distance greater than the length of the ridges of the engagement thread arrangement of the lid cap.

11. The apparatus of claim 9:

wherein the mouth member includes a lip on an upper end thereof and an annular ledge on the mating surface disposed downward of the engagement thread arrangement;

wherein the ridges of the engagement thread arrangement of the mouth member each include a distal portion that is spaced from the annular ledge by a distance greater than the width of the ridges of the engagement thread arrangement of the lid cap;

wherein in the first stage of the rotational interference fit each ridge of the engagement thread arrangement of the lid cap is engaged with the distal portion of a corresponding ridge of the engagement thread arrangement of the mouth member; and wherein the range of translatable motion of the lid cap relative to the body shell in the first stage of the rotational interference fit is defined by the distance between the distal portion and the annular ledge.

12. The apparatus of claim 11:

wherein the ridges of the engagement thread arrangement of the mouth member each further include a proximal portion that is spaced from the annular ledge by a distance less than the width of the ridges of the engagement thread arrangement of the lid cap; and wherein in the second stage of the rotational interference fit, at least a portion of each ridge of the engagement thread arrangement of the lid cap is wedged between the proximal portion of a corresponding ridge of the engagement thread arrangement of the mouth member and the annular ledge.

13. The apparatus of claim 11:

wherein the mating surface of the mouth member includes a peripheral gasket;

wherein the mating surface of the lid cap includes a corresponding sealing surface;

wherein in a non fluid-tight position the sealing surface does not engage the peripheral gasket; and wherein in a fluid-tight position the sealing surface sealingly engages the peripheral gasket.

14. A kit, comprising:

the apparatus of claim 1;

at least one shock absorbing stabilizing disk having an outer diameter of a dimension adapted to engage the interior surface of the body shell in a friction fit; and a guide member having concentric circle indicia of different diameters thereon and adapted to be concentrically aligned with the stabilizing disk by means of the circle indicia, the circle indicia including indicia indicating the diameter of the interior surface of the body shell.

15. A kit for receiving and protecting interchangeable camera lenses comprising:

a cylindrical body shell, the body shell including an outer rigid casing having inner and outer diameters, and an inner soft-lined receptacle within the inner diameter of the body shell for receiving a lens therein;

a base end cap positioned at a bottom end of the body shell to form a closed-end floor therewith, with a visco-elastic material disposed thereon;

a ring-shaped mouth member disposed at the top end of the body shell forming an opening sized to receive a camera lens, the mouth member including an engagement thread arrangement;

a lid cap including a complementary engagement thread arrangement and adapted to removably engage the mouth member by means of a rotational interference fit accomplished by engaging the engagement thread arrangements, the lid cap including a visco-elastic material disposed to extend into the body shell when the lid cap is engaged with mouth member;

at least one shock-absorbing stabilizing disk having an outer diameter of a dimension adapted to engage the interior surface inner soft-lined receptacle in a friction fit; and a guide member having concentric circle indicia of different diameters thereon and adapted to be concentrically aligned with the stabilizing disk by means of the circle indicia, the circle indicia including indicia indicating the diameter of the interior surface of the body shell.

16. The kit of claim 15, wherein the guide member is adapted to assist a user to form, from the stabilizing disk, a customized stabilizing ring having an interior diameter sized to accommodate a portion of a camera lens and maintain a spaced relationship between the accommodated portion of the camera lens and the interior surface of the body shell.

17. The kit of claim 16:

wherein one of the mouth member and the lid cap assumes a male configuration that includes an outward facing mating surface, and the other of the mouth member and the lid cap assumes a female configuration that includes an inward-facing mating surface configured to at least partially overlap the inward-facing mating surface when the lid cap is engaged with the mouth member;

wherein the engagement thread arrangements are disposed on the respective mating surfaces and each include two or more ridges each protruding from and extending partway around the respective mating surface, with the adjacent ridges of one of the engagement thread arrangements being at least partially inclined and including upper ends that are spaced from each other by a distance greater than the length of the ridges of the other of the engagement thread arrangements;

wherein respective engagement thread arrangements are engageable in any of a number of relative orientations of the lid cap to the mouth member; and wherein the number of relative orientations corresponds to the number of ridges of each engagement thread arrangement.

18. The kit of claim 16:

wherein the lid cap that is removably engageable in a two-stage rotational interference fit with the mouth member, in which the lid cap is retained thereto;

wherein in a first stage of the rotational interference fit, the lid cap is translatable along the axis of the body shell, with respect to the mouth member, between a non fluid-tight position and a fluid-tight position; and wherein in a second stage of the rotational interference fit, the lid cap is retained in a fluid-tight position.

19. A threaded joint apparatus of the type in which a cylindrical female member includes an inward-facing annular mating surface and a cylindrical male member includes an outward-facing annular mating surface adapted to selectively engage the inward-facing annular mating surface in a rotational interference fit, the apparatus comprising:

a first engagement thread arrangement disposed on the inward-facing mating surface and including a number of ridges protruding from and extending partway around the mating surface; and a second engagement thread arrangement disposed on the outward-facing mating surface and including an annular ledge and a corresponding number of ridges each extending generally upward therefrom and partway around the respective mating surface, with the upper ends of adjacent ridges being spaced from each other a distance greater than the length of the ridges of the second engagement thread arrangement;

wherein the engagement thread arrangements are removably engageable in a two-stage interference fit, wherein in a first stage each ridge of the first engagement thread assembly is slidably captured between an upper portion of a corresponding ridge of the second engagement thread assembly and the annular ledge thereof, and wherein in a second stage each ridge of the first engagement thread assembly is wedged between a lower portion of a corresponding ridge of the second engagement thread assembly and the annular ledge thereof; and wherein in the first stage the male and female members are relatively translatable along the central axis thereof in a range of motion corresponding to the distance between the upper portions of the ridges of the second engagement thread assembly and the annular ledge.

20. The threaded joint apparatus of claim 19, farther comprising a peripheral gasket on one of the mating surfaces; and a sealing surface on the other of the mating surfaces;

wherein in the first stage the range of motion is between a fluid-tight position in which the peripheral gasket sealingly engages the sealing surface and a non fluid-tight position in which the peripheral gasket does not engage the sealing surface; and wherein in the second stage the peripheral gasket sealingly engages the sealing surface.

* * * * *